US011062593B2

(12) United States Patent
Oliver et al.

(10) Patent No.: US 11,062,593 B2
(45) Date of Patent: Jul. 13, 2021

(54) ALARM MODULE WITH WIRELESS CONFIGURATION CAPABILITY

(71) Applicants: Brian Oliver, Rancho Santa Margarita, CA (US); Sukumar Sinniah, Irvine, CA (US); Jaral Pasin, Valencia, CA (US)

(72) Inventors: Brian Oliver, Rancho Santa Margarita, CA (US); Sukumar Sinniah, Irvine, CA (US); Jaral Pasin, Valencia, CA (US)

(73) Assignee: Hochiki America Corporation, Buena Park, CA (US)

( * ) Notice: Subject to any disclaimer, the term of this patent is extended or adjusted under 35 U.S.C. 154(b) by 0 days.

(21) Appl. No.: 16/856,818

(22) Filed: Apr. 23, 2020

(65) Prior Publication Data

US 2020/0342745 A1 Oct. 29, 2020

Related U.S. Application Data

(60) Provisional application No. 62/838,454, filed on Apr. 25, 2019.

(51) Int. Cl.
*G08B 25/10* (2006.01)
*G08B 25/00* (2006.01)

(52) U.S. Cl.
CPC ..... *G08B 25/10* (2013.01); *G08B 25/008* (2013.01)

(58) Field of Classification Search
CPC ..... G06F 21/62; G06F 2221/2141; H04L 41/0893; H04L 41/5051; H04L 12/2827; G01J 5/041
See application file for complete search history.

(56) References Cited

U.S. PATENT DOCUMENTS

2013/0009771 A1* 1/2013 Simon ..... G08B 25/10 340/539.1
2014/0085092 A1* 3/2014 Fadell ..... G08B 21/22 340/628
2015/0088331 A1* 3/2015 Fiedler ..... H04L 12/2803 700/295
2016/0363915 A1* 12/2016 Warren ..... G05B 15/02
2019/0304274 A1* 10/2019 Britton ..... G08B 13/19656

* cited by examiner

*Primary Examiner* — Mirza F Alam
(74) *Attorney, Agent, or Firm* — Venjuris P.C.

(57) ABSTRACT

An alarm module for interfacing with a monitoring type or output type alarm device and capable of configured by a wireless transmission device held in close proximity to the alarm module.

18 Claims, 17 Drawing Sheets

ALARM MODULE WITH WIRELESS CONFIGURATION CAPABILITY

FIELD OF THE INVENTION

The present invention relates to alarm modules that may be configured in the field or during installation, and a system architecture for an alarm module that enables configuration in the field or during installation.

SUMMARY OF THE INVENTION

The invention may be generally described as an alarm module design and method that enables configuration by a hand-held wireless configuration device held in close proximity to the alarm module. The alarm module includes a wireless communication device configured to communicate module configuration transmissions with the wireless configuration device operating a software process to receive and transmit module configuration transmissions to the alarm module. A processor is coupled to the wireless communications device and processes the module configuration transmissions according to the alarm module capabilities and the system requirements as determined by a user operating the wireless configuration device. The alarm module includes at least one of a variety of alarm device connection circuits that is designed to interface with standard monitoring-type or output-type alarm device. In use, the alarm module may be used in an alarm system and connected to an alarm system control panel, and the wireless configuration device positioned within the immediate proximity of the alarm module to communicate the alarm module configuration transmissions.

An aspect of the alarm module enables alarm module variations wherein the at least one configurable alarm device connection circuit is selected from a configurable contact monitor, a configurable current monitor, a configurable SLC powered zone monitor, a configurable SLC powered relay output, a configurable supervised output, a configurable short circuit isolator, and a configurable remote indicator. In another aspect, the type of configurable alarm device connection circuit is communicable to the alarm module and the configuration options selected by the user and communicated back to the alarm module for configuration. Still another aspect of the invention is the enclosure of the alarm module into an alarm module housing sized and dimensioned for receipt into a single gang box, or one or more modules can be installed side-by-side into a multiple gang box.

The alarm module system architecture enables a method of configuring and of facilitating configuration of an alarm module. The method may include communicating module configuration transmissions between the alarm module and a wireless configuration device positioned proximate to the alarm module, displaying at least one alarm module configuration option obtained as a result of the module configuration transmissions on a visual display of the wireless configuration device. The method may further include identifying the variety of alarm module with which the wireless configuration device is positioned proximate based the module configuration transmissions, displaying options for and enabling programming of the address of the alarm module to be used by an alarm system control panel, displaying instructions for positioning a wireless configuration device within the immediate proximity of the alarm module on the wireless configuration device, displaying options for configuring the alarm module 1 for a monitoring alarm device selected from a relay monitoring input, a current source monitoring input, a contact monitor input, and a SLC powered zone monitor, and/or displaying options for configuring the alarm module for an alarm output device selected from a normally open relay module, a normally closed relay module, a supervised relay output.

Numerous advantages and features of the present invention will become readily apparent from the following detailed description of the invention and the embodiments thereof, from the claims and from the accompanying drawings.

Figure 1:
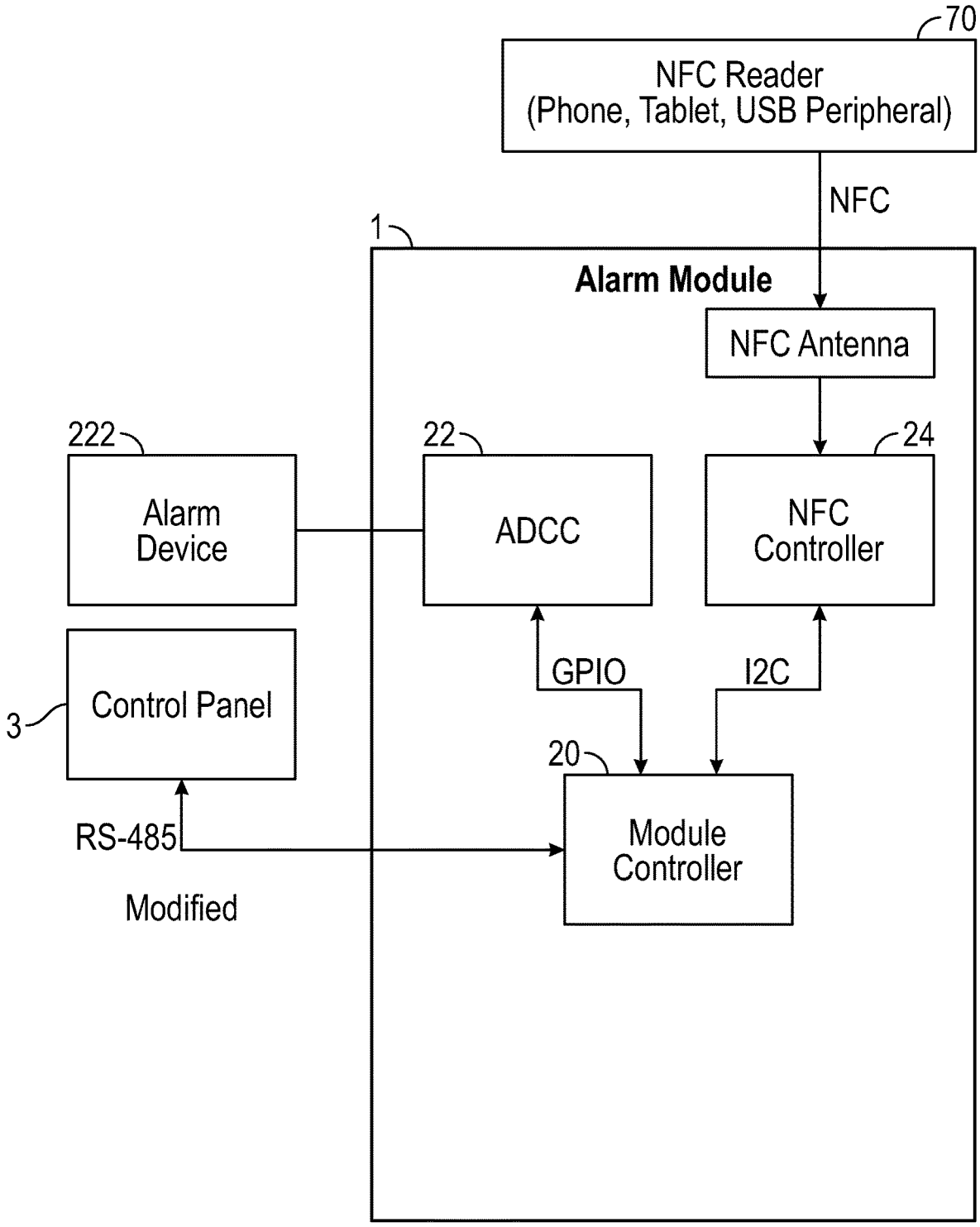
FIG. 1 illustrates a block diagram including aspects of the described embodiment.

The objects, features and advantages of the present invention will be more readily appreciated upon reference to the following disclosure when considered in conjunction with the accompanying drawings, wherein reference numerals are used to identify the components in the various views.

DESCRIPTION OF PREFERRED EMBODIMENTS

The figures illustrate an embodiment of a configurable alarm module 1 and a method of configuring an alarm module 1. The configurable alarm module 1 as described herein may represent a component of an installed alarm system comprising an alarm system control panel 3, Signaling Line Circuit (SLC) wiring, and at least one of a variety of conventional monitoring-type or output-type alarm devices 222 interfaced to the configurable alarm module 1. See FIG. 1. Moreover, while the alarm module 1 may be selected and configured to interface with any of a variety of conventional off-the-shelf and existing monitoring-type or output-type alarm device 222, the alarm module 1 may be interfaced to yet to be developed alarm devices 222 due to the alarm module 1 system architecture, which emphasizes and enables adaptability. Accordingly, the features of the disclosed embodiment should not be construed as intending to limit any aspect of the invention unless specifically so expressed. Of course, it is also contemplated that any specific input or output alarm device 222 could be incorporated into an alarm module 1, which may require packaging the alarm module 1 other than as disclosed in the preferred embodiment.

A preferred embodiment of the configurable alarm module 1 includes a proximity-dependent wireless communications device 24 (e.g. NFC communication device), at least one alarm device connection circuit 22, and an alarm module controller, microcontroller, or processor 20, which are populated onto an alarm module circuit board 25 and functionally interconnected as disclosed by the block diagram. The preferred system hardware architecture features the processor 20 as the primary device to control the operation of the alarm module 1 and execute an executive software process to control operations of the module 1 and communications between system subcomponents and an alarm system control panel 3. The processor 20 may communicate with the wireless communications device 24 using a standard communications protocol such as I2C and the input/output pins of the processor 20 may be coupled to the output/input pins of the alarm device connection circuit 22 according to the variety of alarm device connection circuit 22 and illustrated in the drawings or as described in the discussions regarding particular alarm device connection circuits 22. The processor 20 may be coupled to the alarm system control panel 3 by the SLC wiring and communicate using a standard or modified communications protocol such as RS-485.

Figure 2:
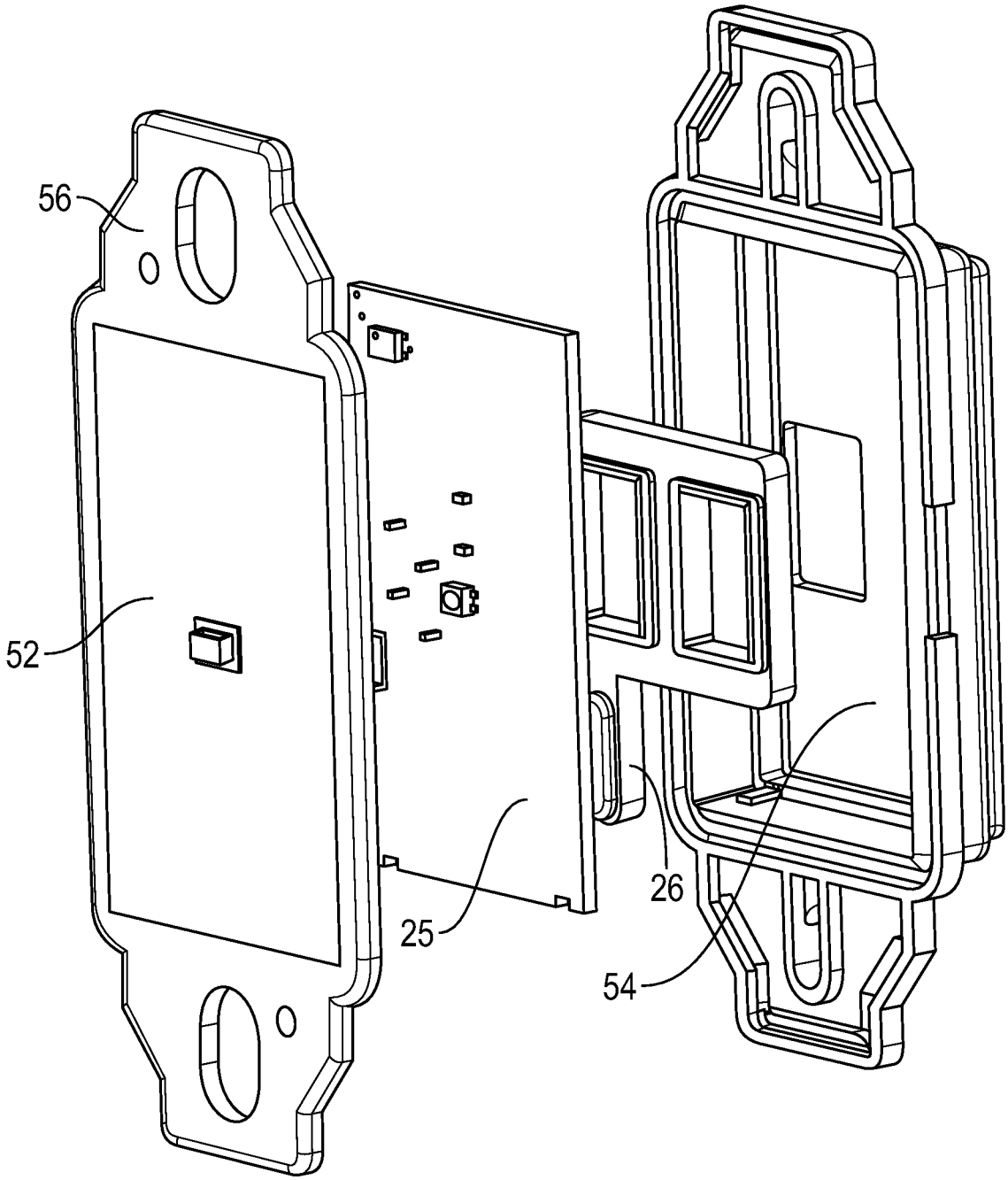
FIG. 2 illustrates a side perspective view of an alarm module 1 and specifically showing the position of the alarm module circuit board 25 between the module housing front 52 and module housing rear 54.
Figure 3A:
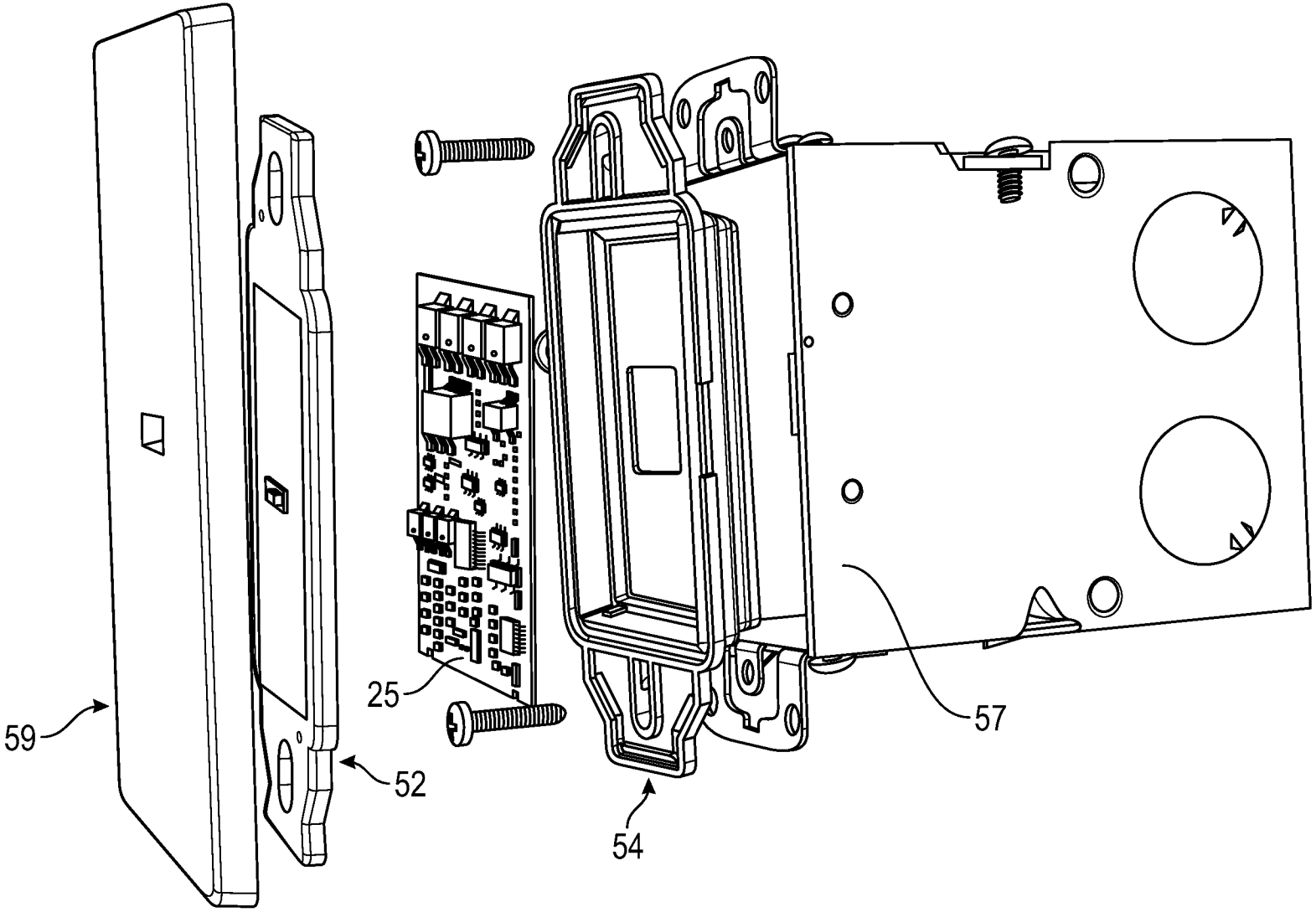
FIG. 3A-3B illustrate exploded views of the embodiment and installation into a single and double gang box 57 that include a gang box front covers 59.
Figure 3B:
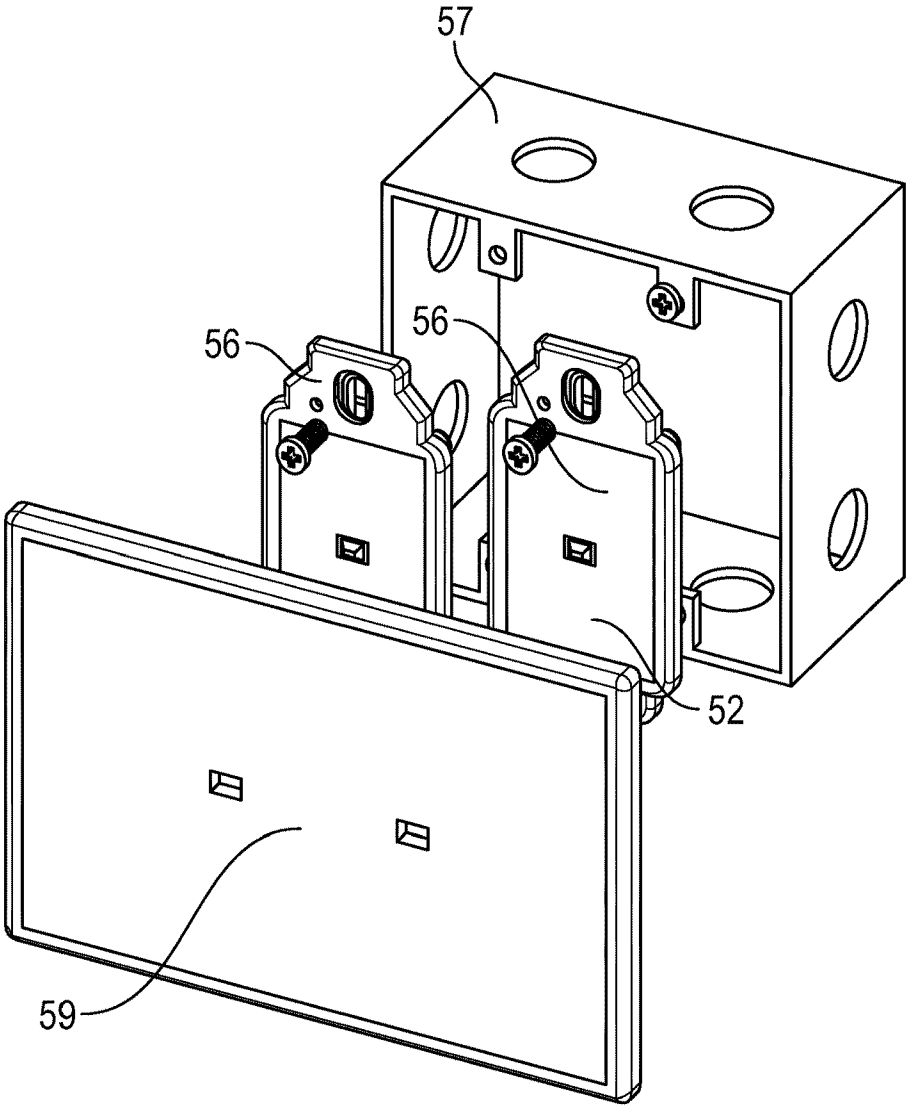

The alarm module circuit board 25 may be enclosed and secured within a module housing 5 as illustrated in FIG. 2 and installed into a single gang box as illustrated in the exploded view of FIG. 3A, or more than one alarm modules 1 installed into a multiple gang-type box as illustrated in FIG. 3B. It is preferred that the gang box have a gang box front cover 59 with an aperture sized and aligned over an indicator LED, which may be located on the module housing front 52 to permit visible indications therefrom or on the alarm module circuit board 25 as illustrated in FIG. 3A. The preferred module housing 5 comprises a substantially flat module housing front 52 and a module housing rear 54 with a cavity sized and dimensioned to receive the alarm module circuit board 25. A housing mounting flange 56 extends from the front of at least one of the module housing front 52 and module housing rear 54 with a mounting-aperture aligned with the mounting apertures of the gang box. Finally, a gasket 26 may be positioned between the alarm module circuit board 25 and the module housing rear 54 to deter moisture from entering the alarm module 1 and damaging the components therein, and an aperture in the module housing rear 54 may expose contacts on the alarm module 1 to facilitate electrical connection to the alarm system SLC wiring.

The alarm module 1 may be interfaced with the alarm system control panel 3 by a SLC wired connection as is standard in the art and for the purposes known in the art. The alarm module 1 variety selected for application or use within any given fire alarm system depends on the specific configurable alarm device connection circuit 22 included therein, which itself depends on the variety of monitoring-type or output-type alarm device 222 selected for use and interface with the alarm module 1. Moreover, because there is no single and standard interface circuit that will accommodate all of the variety of monitoring-type or output-type alarm devices 222, several alternate alarm module 1 varieties are produced and packaged within the standard sized module housing 5, wherein each variety of alarm module 1 has an alarm device connection circuit 22 may be capable of interfacing with at least one of the variety of monitoring-type or output-type alarm devices 222 that are commonly used in alarm system installations. For example, the alarm module 1 may thus be used with any of a variety of monitoring-type or output-type alarm devices 222, which different device types may comprise monitoring-type alarm devices 222 such as contact detectors, a current detectors, and zone detectors, etc.; and output-type alarm devices 222 such as relays, relay-controlled devices, supervised outputs, audible or visual indicators, short-circuit isolators, and remote indicators, etc. It follows that there is at least one alarm module 1 variety including an alarm device connection circuit 22 capable of interfacing with each variety of monitoring-type or output-type alarm devices 222.

Figure 4A:
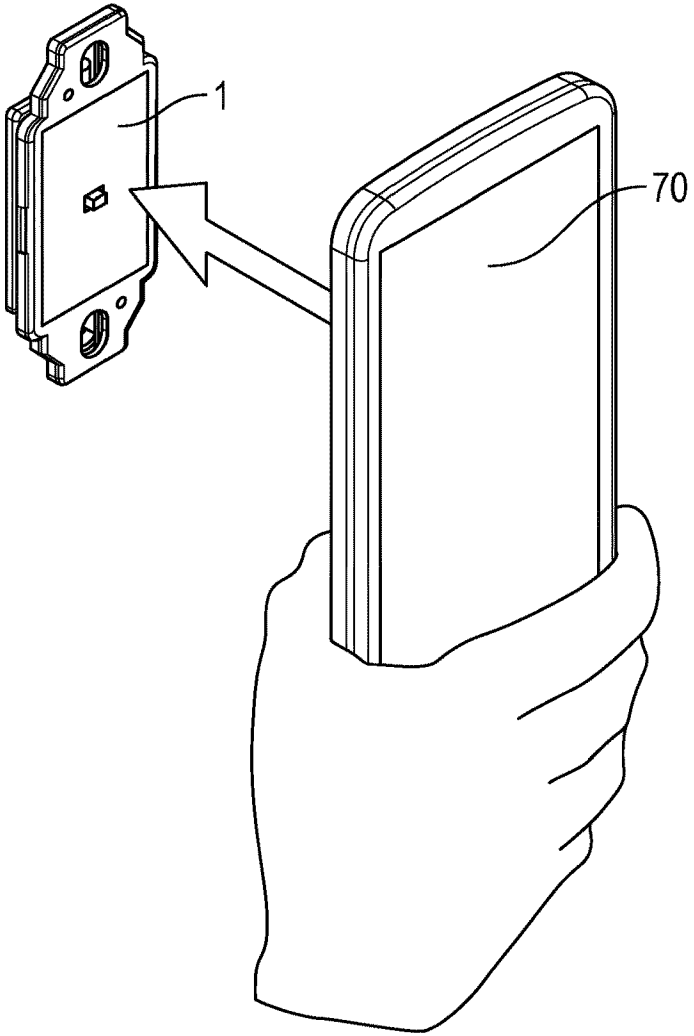
FIG. 4A illustrates positioning a wireless configuration device 70 proximate to the alarm module 1 to initiate and complete module configuration transmissions 200 and configuration of the alarm module 1.
Figure 4B:
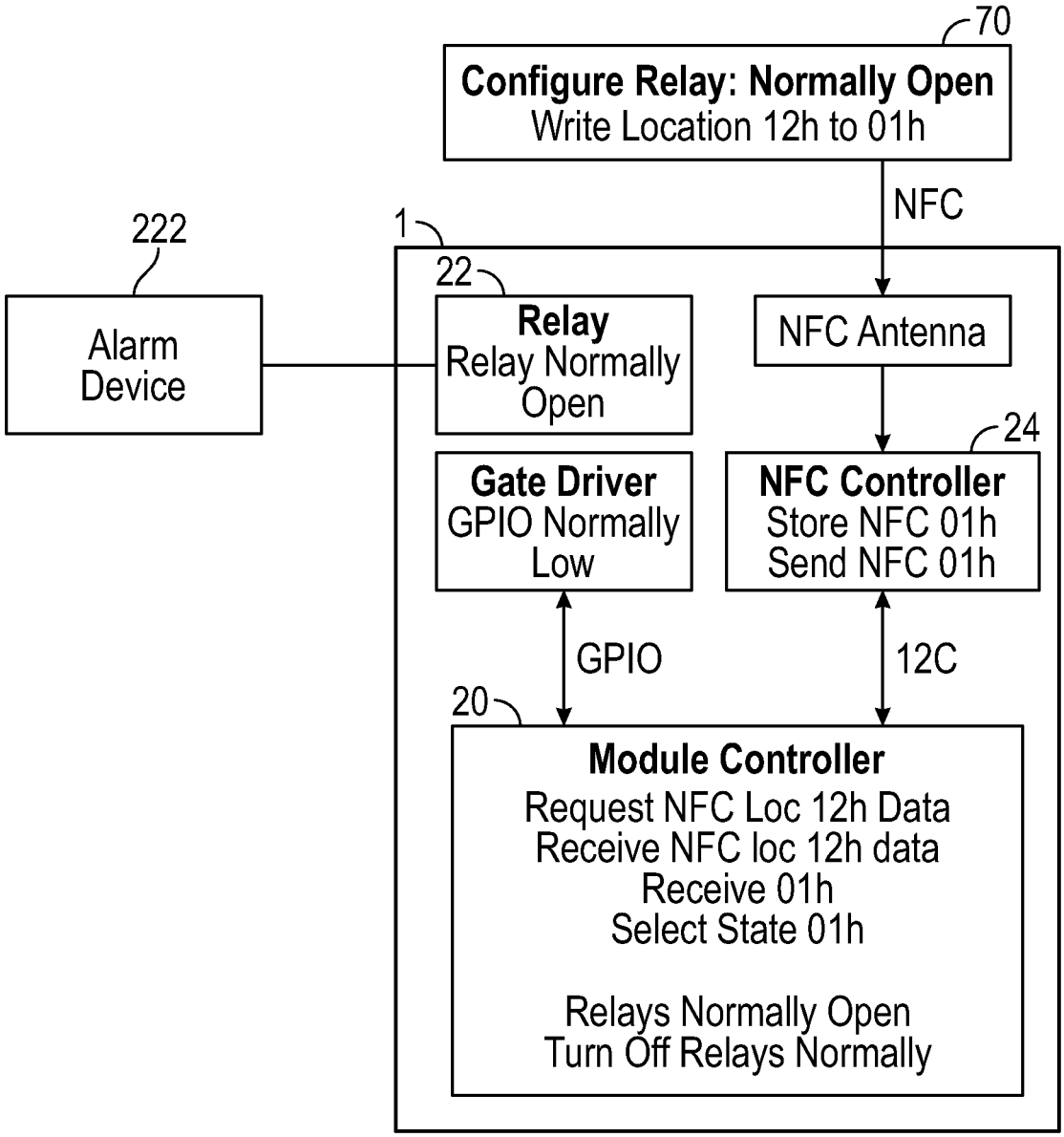
FIG. 4B illustrates the result of module configuration transmissions 200 between the wireless configuration device 70 and the alarm module 1 including setting default condition of the alarm device connection circuit 22 to be coupled to an alarm device 222 with normally open relay condition.

In an exemplary use of the alarm module 1 within a fire alarm system installation, the variety of alarm module 1 (i.e. with an appropriate alarm device connection circuit 22 therein) is connected to a compatible corresponding alarm device 222, and the alarm module 1 is connected to the alarm system control panel 3 by SLC wiring. The alarm module 1 may then be configured during the alarm system installation, or during a service request for a system upgrade, modification, or maintenance, by use of a wireless configuration device 70 that is positioned proximate to the alarm module 1. In a preferred method of configuration, the wireless configuration device 70 is positioned before or within the immediate proximity of the alarm module 1 (see FIG. 4A), which connects to the wireless communications device 24 (or components associated with the wireless communications device 24 such as an NFC tag) the within the alarm module 1 and communicates with the alarm module 1 as prompted by a software process on the wireless configuration device 70 and depending on data read from the alarm module 1. See FIG. 4B. In preferred alarm module 1 embodiments, the module configuration transmissions 200 between the alarm module 1 and wireless configuration device 70 may be based on any technology capable of wireless communication and the transmissions may include any of several types of information and data relevant to the alarm module 1 including such as; information capable of authenticating the make, model, and serial number of the alarm module 1, and configuration options for the alarm module 1 based on the variety of alarm module 1 and alarm device connection circuit 22 therein. In the illustrated embodiment, module configuration transmissions 200 may be based on proximity-based transmissions between inductively coupled antennas as is the case with Near Field Communications (NFC) technology.

Figure 5A:
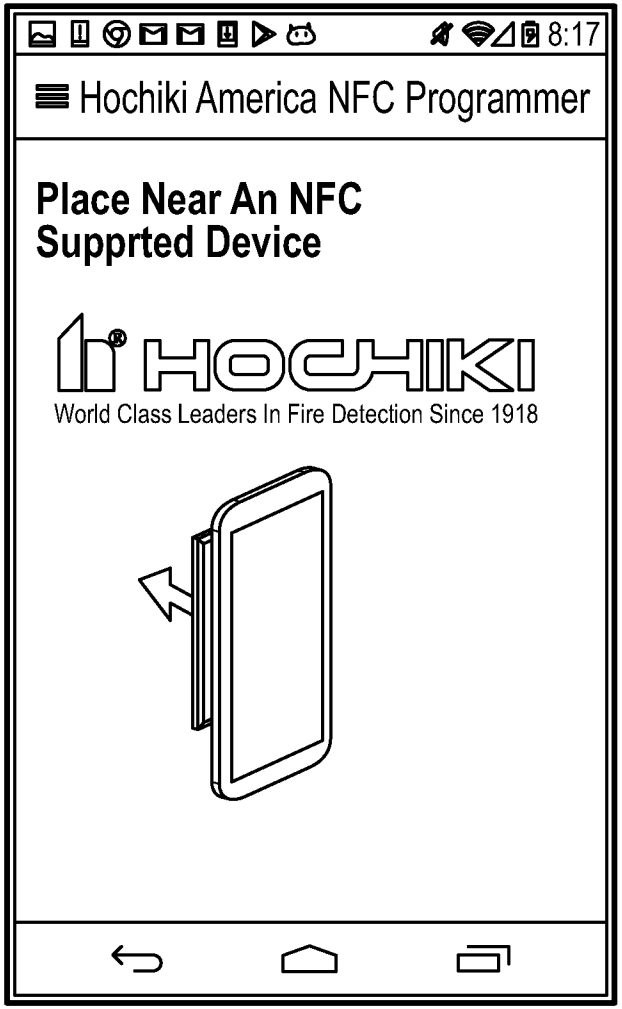
FIGS. 5A-5G illustrate screen shots of a reader and configuration application operated by a user of the wireless configuration device 70 to cause module configuration transmissions 200 and configure the alarm module 1.
Figure 5B:
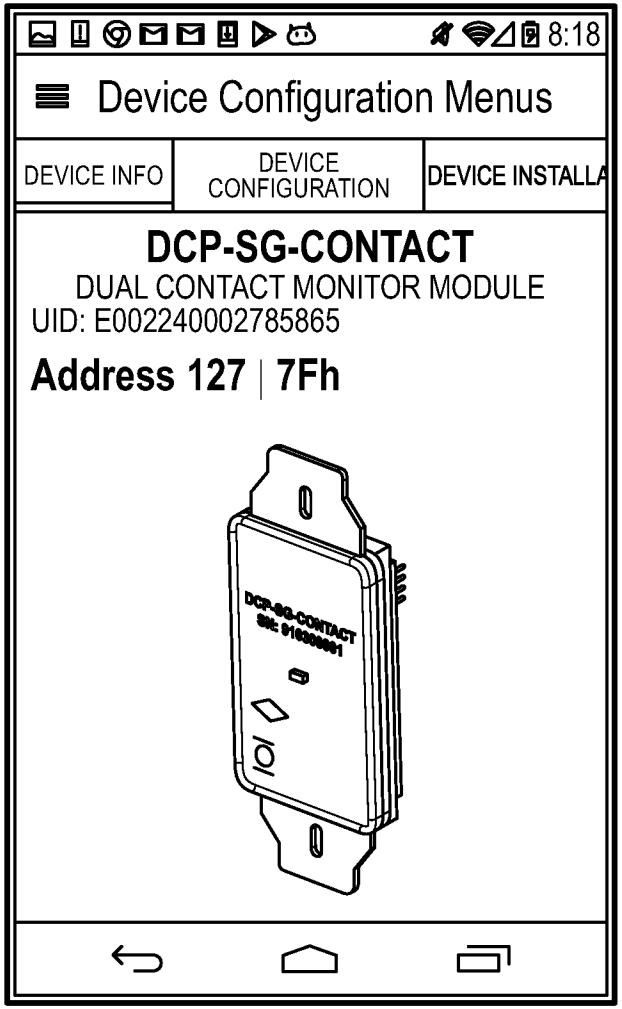
Figure 5C:
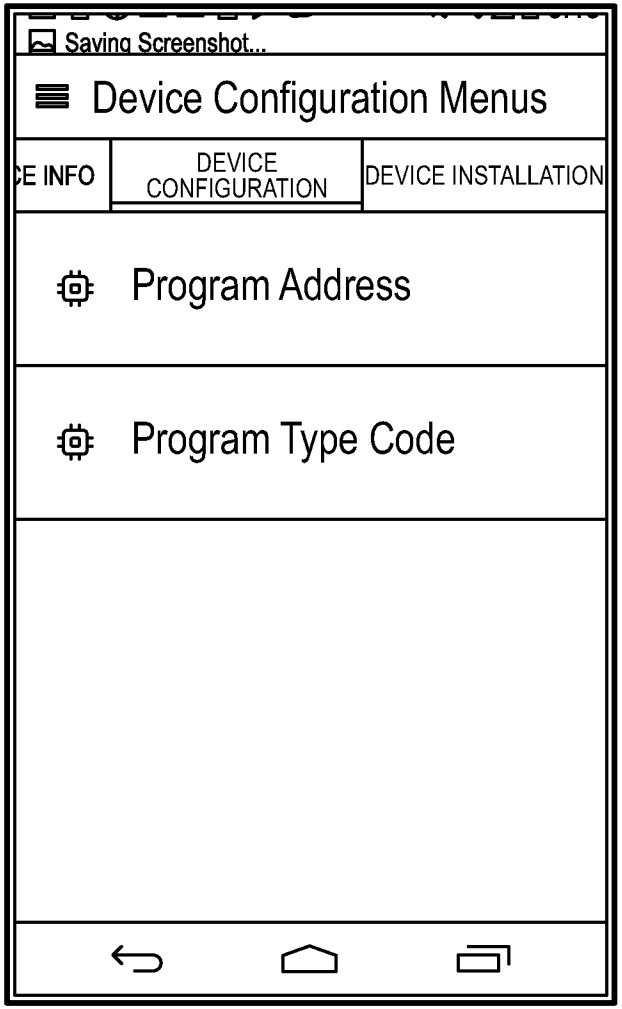
Figure 5D:
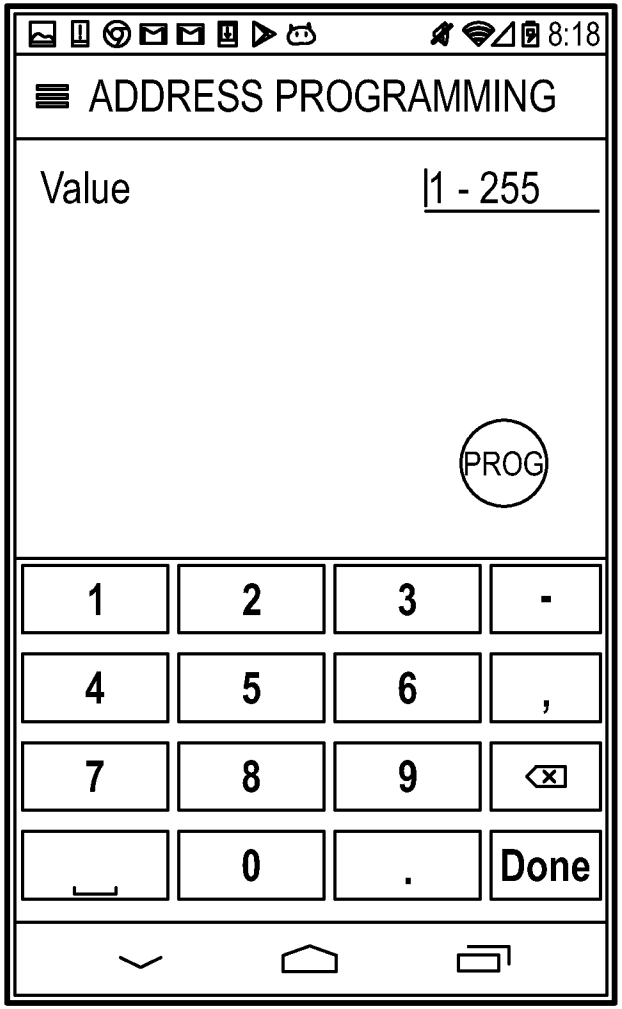
Figure 5F:
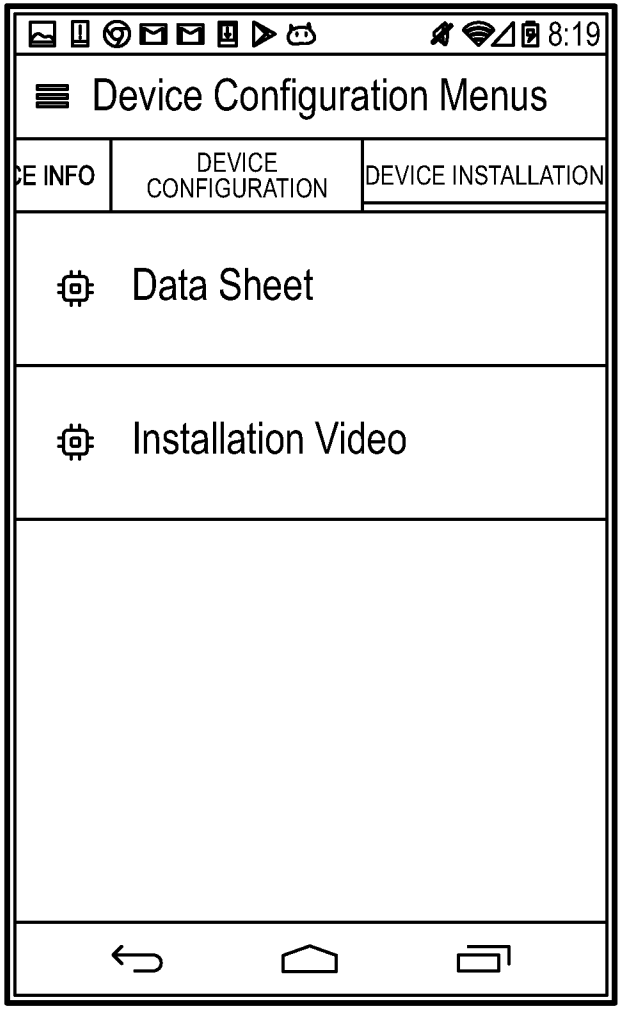
Figure 5E:
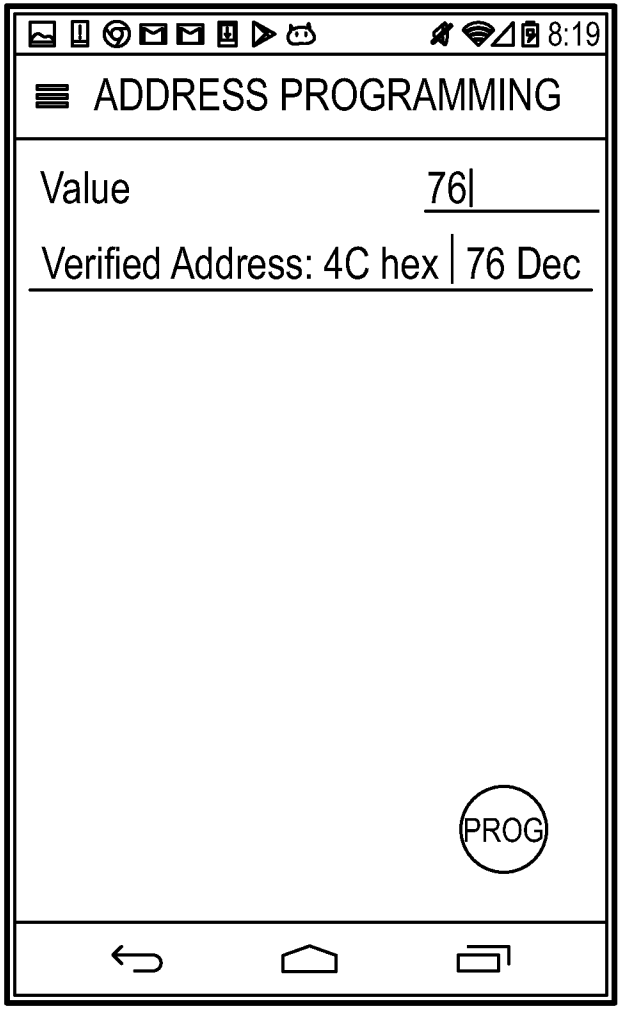
Figure 5G:
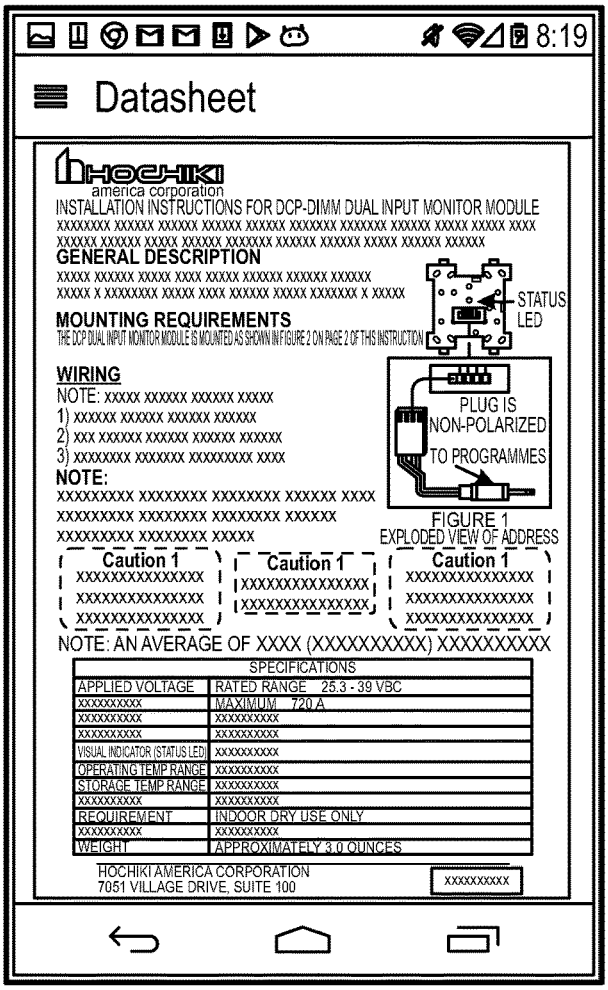

FIGS. 5A-5E illustrate screen shots of the results of a software process or application resident on or accessed on an Internet Website by a user of the wireless configuration device 70 that facilitate configuration of the alarm module 1. FIG. 5A illustrates that the software process of the wireless configuration device 70 provides a textual and visual instruction to the user to position the wireless configuration device 70 in front of the alarm module 1 to initiate alarm module 1 and wireless configuration device 70 configuration transmissions 200 (e.g. read an NFC tag). FIG. 5B illustrates the result of one or more module configuration transmissions 200 wherein the make, model, type of alarm module 1, and module address, or address configuration option, is communicated to the wireless configuration device 70 and presented to the user as a visual display. As illustrated, the software process operating on the wireless configuration device 70 may comprise several navigable states and options for module configuration and/or informative displays at each navigated state. A user of the wireless configuration device 70 may then navigate the software states, select from menu options, and access one or more input fields or available sections designed specifically for configuration of the alarm module 1 and alarm device connection circuit 22 as is appropriate for the fire alarm system and connected alarm device 222. User commands, selections, or other inputs are then encoded by the software process of the wireless configuration device 70 into module configuration transmissions 200 that transmitted to and received by the wireless communications device 24 of the alarm module 1, and used by the processor 20 to configure the operation of the alarm module 1, based on the specific module configuration transmissions 200 received.

FIGS. 5C-5G illustrate menus and options for programming the address of the alarm module 1 used by the alarm system control panel 3 to communicate with the alarm module 1, and installation and informational datasheet displays that may be used by an installer or service technician to configure the alarm module 1. Another option may comprise configuration of the alarm module 1 to make it backwards compatible by emulating protocols or addressing used by older model alarm devices 222 or alarm system control panels 3. Yet another example comprises configuration of at least one electrical characteristic of the alarm device connection circuit 22 to accommodate the input/output electrical requirements or capabilities of an alarm device 222 that is or will be connected, which that may hasten system installation and initialization of the SLC loop.

Configuration Options by NFC Interface

The preferred alarm module 1 design and components allow configuration based on a proximate positioning of the wireless configuration device 70. In the preferred embodiment, wireless communications device 24 of the alarm module 1 comprises a Near Field Communications (NFC) controller with an associated NFC tag and the method of configuration is via an NFC reader of a wireless configuration device 70 and module configuration transmissions 200 comprises reading of and/or writing of data to the NFC tag by a NFC reader application executing on the wireless configuration device 70.

For example, to configure the alarm module 1 addressing, the NFC tag memory is read from and written to by a reader application operating on the wireless configuration device 70. In this example, because the NFC memory is part of the tag, the wireless configuration device 70 may read to or write to it without power, and without risk to the main processor 20. Thereafter, NFC memory location may be read from by the alarm module processor 20 via I2C interface on startup or reset. Read and write functions may be protected by password at the NFC tag command level. As one example, the user password may comprise a setting to the tag memory similar to the address and the user password may be of length to match the alarm system control panel 3 requirements e.g. for L@titude control panel "999999" options, password 0 is not allowable since this would indicate a null tag or a tag that has not been factory defaulted to "1."

Identification of the variety of any given alarm module 1 may be by writing a unique variety code to the NFC tag during manufacture and making that same variety code available to the reader application on the wireless configuration device 70 i.e. either by a defaulted setting for the type code that is stored in NFC tag memory and wireless configuration device 70 memory. Thus, several unique type codes may be used and/or the alarm module 1 may initially power on to operate in a backwards compatible mode with any given alarm system control panel 3 but then each alarm module 1 may also eventually be programmed so that a newer alarm system control panel 3 may exploit the entire alarm module 1 functionality. Accordingly, a user could choose to configure the alarm module 1 to present itself to the alarm system control panel 3 as either an older compatible alarm module 1 or full feature alarm module 1 depending on the system requirements.

The alarm module 1 permits configuration by the installer using the wireless configuration device 70 and processes disclosed herein as an alternative to configuration by a user operating the alarm system control panel 3, thus reducing the setup and loading time required by startup of the panel. Configuration of each variety of alarm module 1 including settings to make the alarm module 1 emulate an older model may be done prior to the alarm system control panel 3 setup. Further, it is advantageous to configure each alarm module 1 via NFC tag since that will speed initialization of the SLC loop. Otherwise, if the alarm system control panel 3 is used to set up the alarm modules 1, it could spend approximately 500 ms per device address for commands and must also send constant communication to ensure alarm system devices are operating. Total alarm system initialization time may take at least 5 s per address on the SLC loop—for a 255-device system, an installer may wait 20 minutes or longer to know the system is functioning properly. The alarm module 1 described herein presents a viable alternative. Instead, a user operating the wireless configuration device 70 may initiate configuration commands using a software process operating thereon might identify the alarm module 1 type and select process and options from a menu and select to program the address or otherwise configure alarm module 1 for the present application. The software process operating on the wireless configuration device 70 writes to a predefined NFC EEPROM location which is read by the alarm module 1 upon startup or after NFC activity has ended. Several examples of alarm module 1 configuration options for different alarm module 1 varieties are listed below:

| Alarm Module 1 Variety | Configuration Options |
|---|---|
| RELAYS | Relay normally closed or normally open, delay time of the relay, pattern of the relay, LED indication, local test of the device, device emulation, password protection, device address |
| CONTACT MONITOR | Inputs monitored as class B or class A wiring, end of line device used, input disabled, input delay, LED indication, device emulation, password protection, device address |
| CURRENT OUTPUT | Thresholds for pre-alarm and alarm, input disabled, input delay, LED indication, device emulation, password protection, device address |

-continued

| Alarm Module 1 Variety | Configuration Options |
|---|---|
| ZONE MONITOR | Class B or class A wiring, input delay, alarm verification, LED indication, local test of the device, device emulation, password protection, device address |
| SUPERVISED OUTPUT MONITOR | Pattern of the output, LED indication, local test of the device, device emulation, password protection, device address |

Alarm Module System Architectures

Figure 6A:
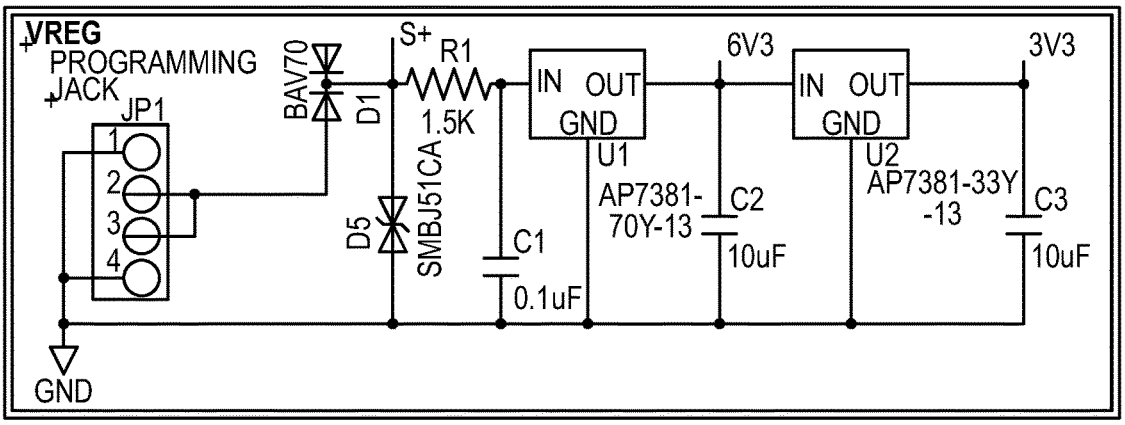
FIGS. 6A-6C illustrate circuits for power input/regulation, communications with an alarm system control panel 3, and for the processor 20, that are used within each alarm module 1.
Figure 6B:
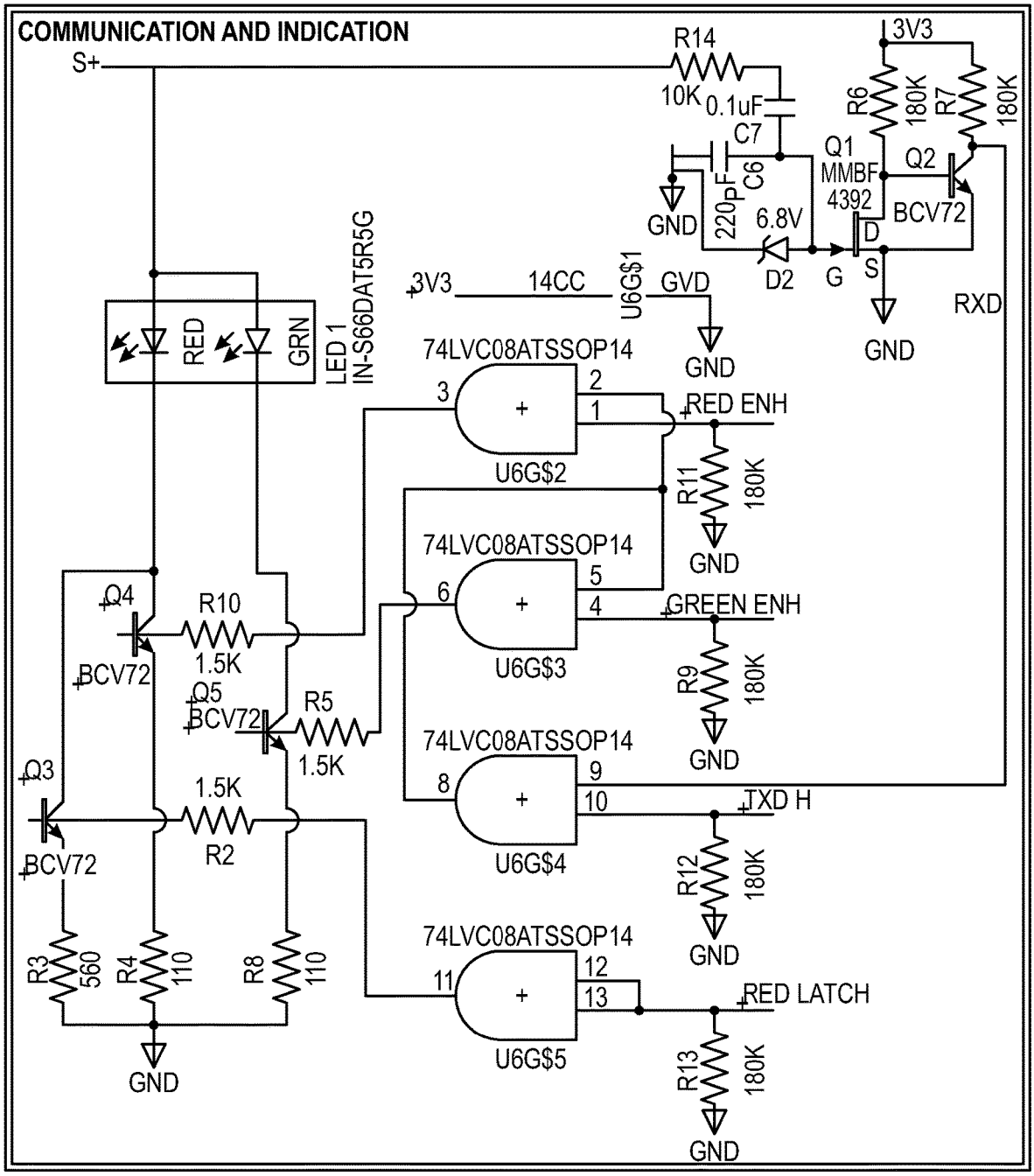
Figure 6C:
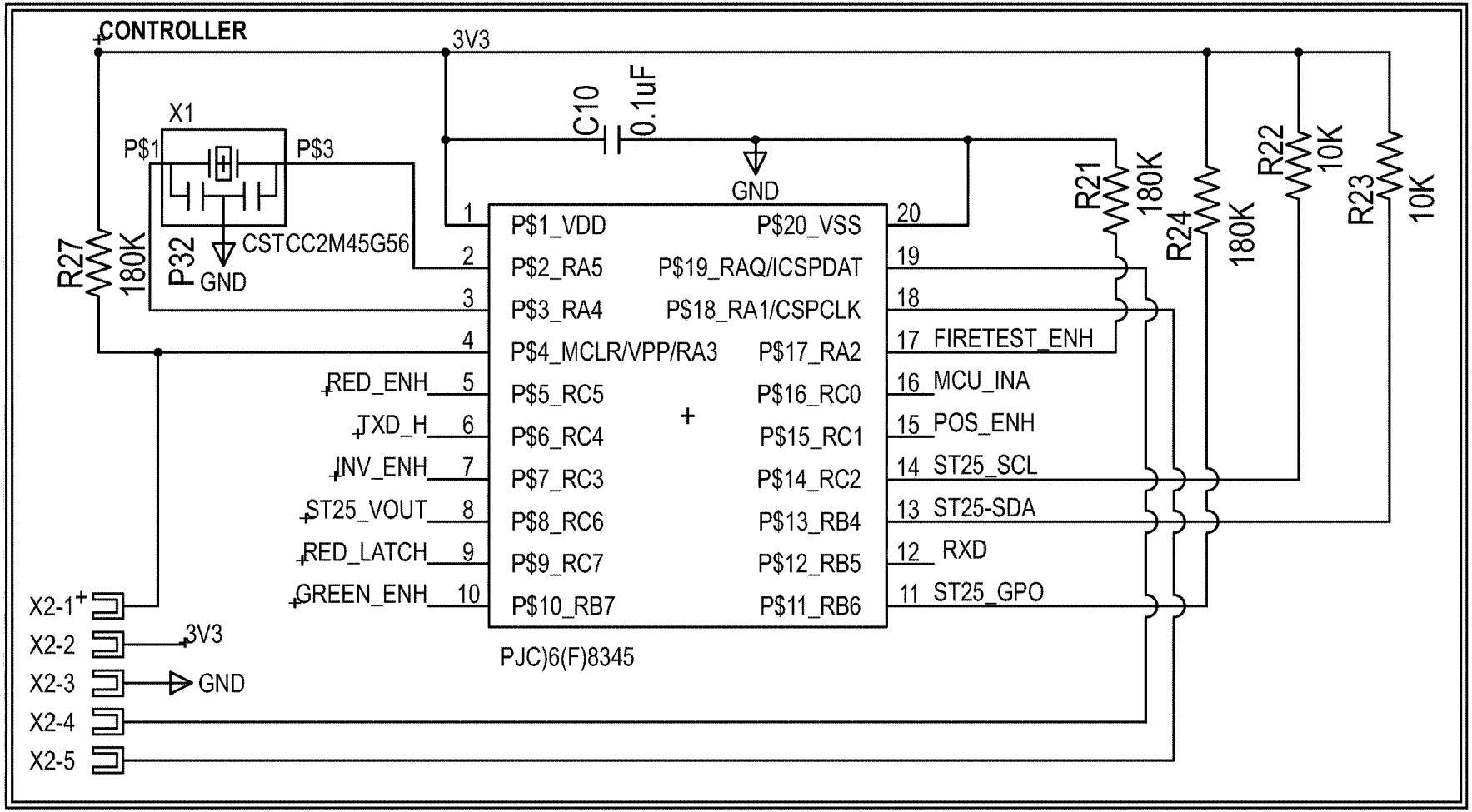

All varieties of alarm modules 1 may share a common core design or alarm module 1 system architecture but differ on the alarm device connection circuit 22. For example, the alarm module 1 system architecture for all varieties may have a mechanical connection circuit as illustrated in FIG. 6A, a SLC communication circuit in FIG. 6B, and a processor 20 or controller circuit as illustrated in FIG. 6C.

Configurable Contact Monitor

Figure 7A:
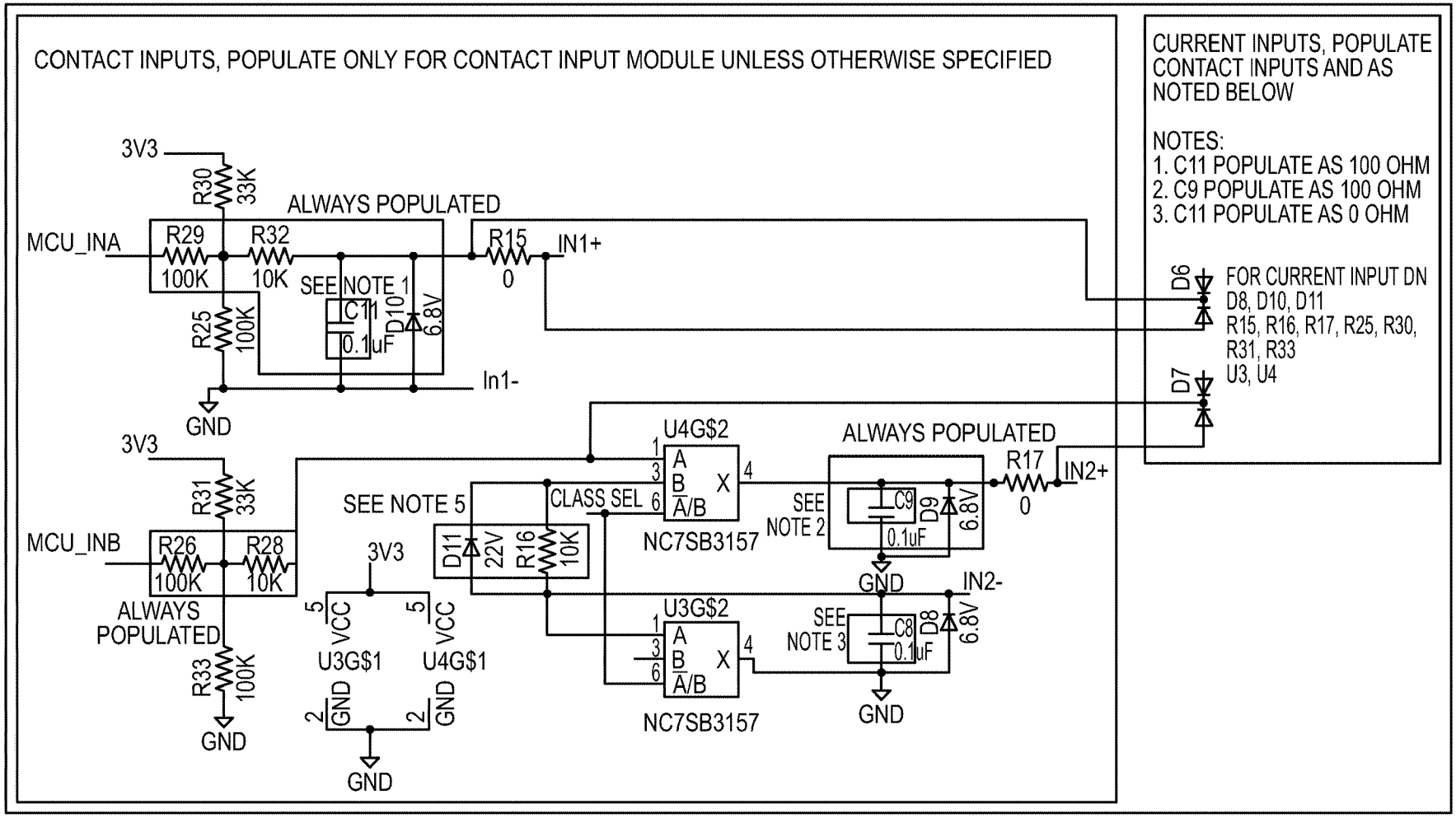
FIG. 7A illustrates the alarm device connection circuit 22 for a contact monitor alarm module 1.

The alarm device connection circuit 22 of the contact monitor alarm module 1 is illustrated in FIG. 7A. The circuit delivers 3.3V to the EOL resistor and monitors the output voltage level through a divider formed by the EOLR and supply resistor. The contact monitor alarm module 1 can interface with all existing contact monitor outputs by software configuration, including: 1 Class B input, 2 Class B input, 1 Class A input.

4-20 mA Current Monitor

The current monitor alarm module 1 shares its core circuit design with the contact monitor alarm module 1 board of FIG. 7A but with slightly different components populated. This design does not use an op amp buffer because the A/D pin consumes very little from the voltage divider. The external current supply is polarity protected, connected to the common ground, and current passes through a 100Ω sense resistor to generate a voltage proportional to the current.

SLC Powered Zone Monitor

Figure 8A:
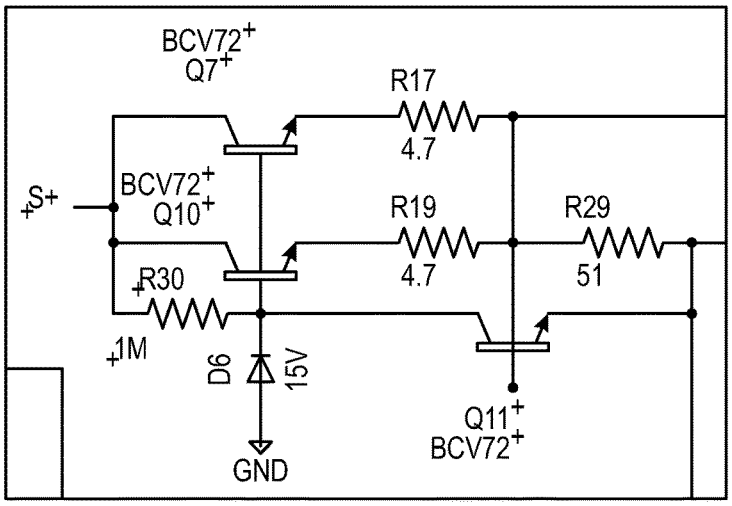
FIG. 8A-8C illustrates alarm device connection circuit 22 for a SLC powered zone monitor alarm module 1 including the zone power regulation circuitry, the zone input to the processor 20 voltage divider, and a zone H-bridge and return for Class A wiring, with a fire test circuit, respectively.

FIG. 8A illustrates an output circuit for the SLC powered zone monitor alarm module 1. The SLC powered zone monitor alarm module 1 outputs a linearly regulated 15V (max) to the powered zone and has a ~10 mA current limit. The module can support up to 25 conventional detectors. However, this will load the SLC such that 255 similar devices cannot be used given the 250 mA or 400 mA maximum ratings. The SLC powered zone monitor alarm module 1 is compatible with monitored detector alarm devices 222 that are bridge rectified (bipolar), with a maximum reset time less than or equal to 0.1 s, and an operating range greater than or equal to 10-16 VDC, with a maximum alarm impedance of 1.5 KΩ inclusive of wiring and base, and with a minimum alarm current less than or equal to 10 mA.

The SLC powered zone monitor alarm module 1 samples for open circuit by reversing polarity through the H bridge every 6 seconds. See FIG. 8C. SOC-24V detectors are fully rectified. The voltage drop is designed to be in the normal running range above 8V. If there is an open circuit the line voltage will be high. Sampling is passed through a filter; provision is made for a diode clamp but could be unnecessary due to high input impedance and integral diode clamp of the controller. Max rating on an IO pin is 50 mA, ESD is clamped by 16V TVS at detector connection, max current would be around 0.2 mA, peak voltage split by R25 divider would be around 2V, so ESD damage to controller seems very unlikely.

Figure 8B:
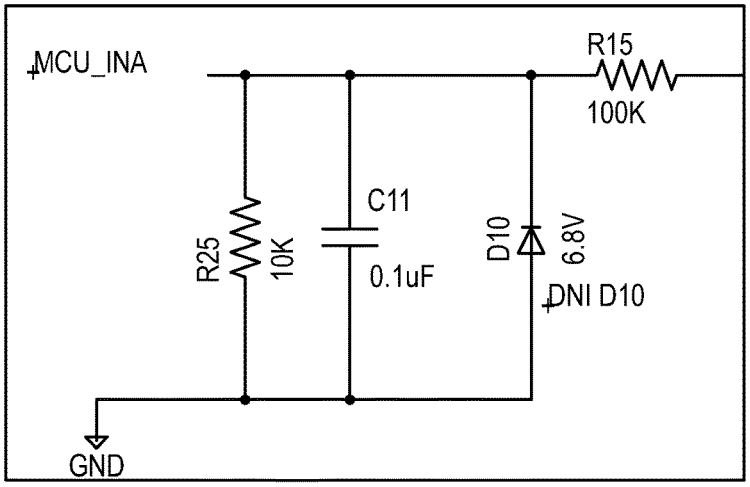

The zone input circuit to the controller or processor 20 is illustrated in FIG. 8B. Under normal non-open circuit conditions in the zone, voltage is in the range of 9.9 to 12.1V (0.9-1.1V at controller), during open circuit conditions, voltage in the zone is 13.2 to 15V (1.2-1.5V at controller). The voltage change is created through an end of line Zener diode rather than a resistor due to current consumption limitations. For Class A wiring, voltage is passed automatically by a diode to the open side of the zone and voltage does not return through the EOL diode which causes a high signal.

Figure 8C:
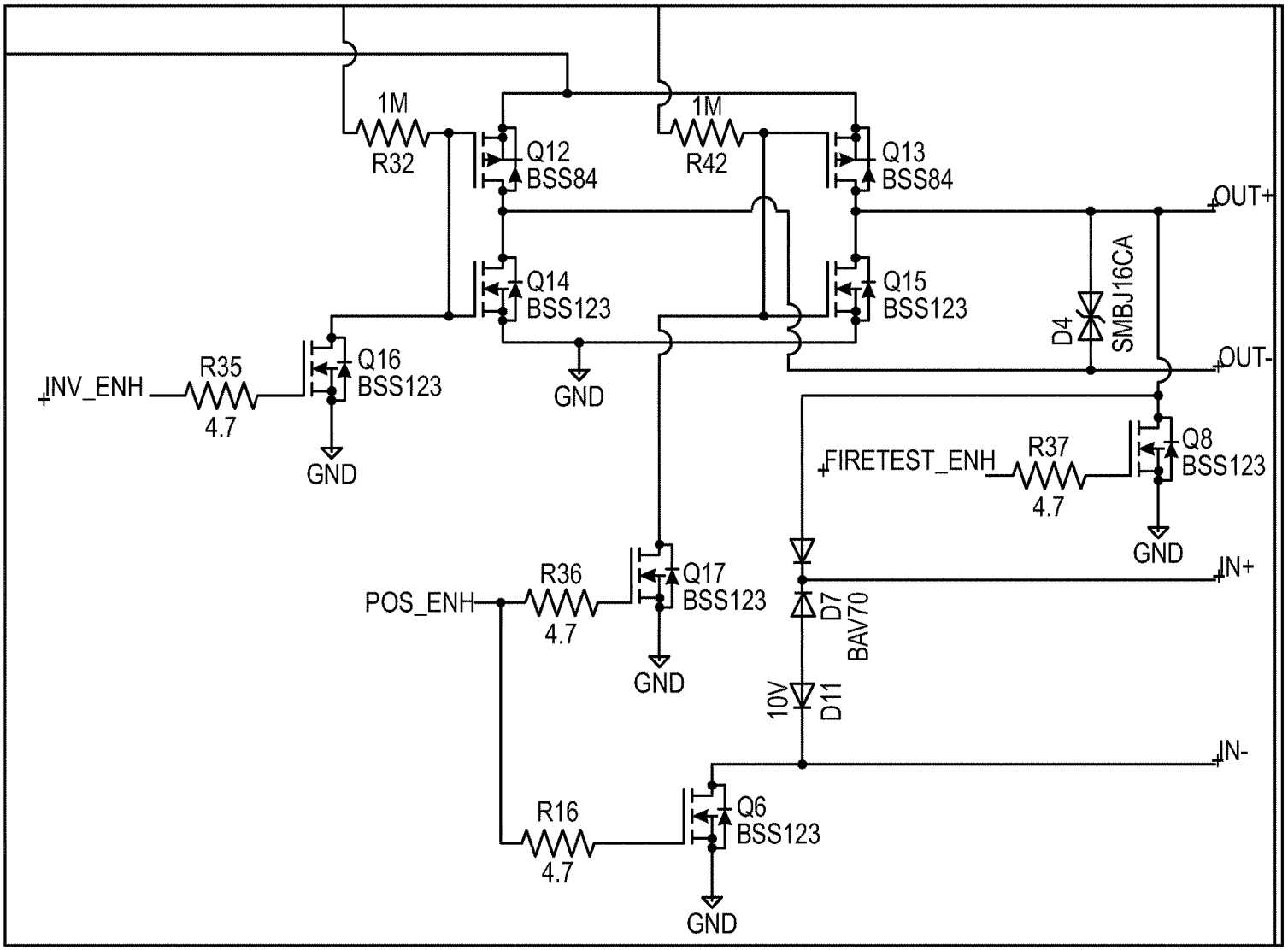

The Zone H-Bridge, and return for Class A wiring, and Fire test circuit is illustrated in FIG. 8C. The alarm module 1 samples for alarm conditions at all other times. A fire Test is provided by shorting the zone outputs through a FET to test the controller's response to a detector's alarm response. Voltage will be low, a maximum alarm impedance of 900Ω. Normal Voltage in the zone is 13V to 15V (1.2~1.5V at controller), Alarm voltage in the zone is 0 to 11V (0~1.0V at controller). Alarm is detected at 2 Kohm with 1 to 25 SOC-24V, maximum alarm impedance should be limited to 900Ω.

SLC Powered Dual Solid-State Relay Output Circuit

Figure 9:
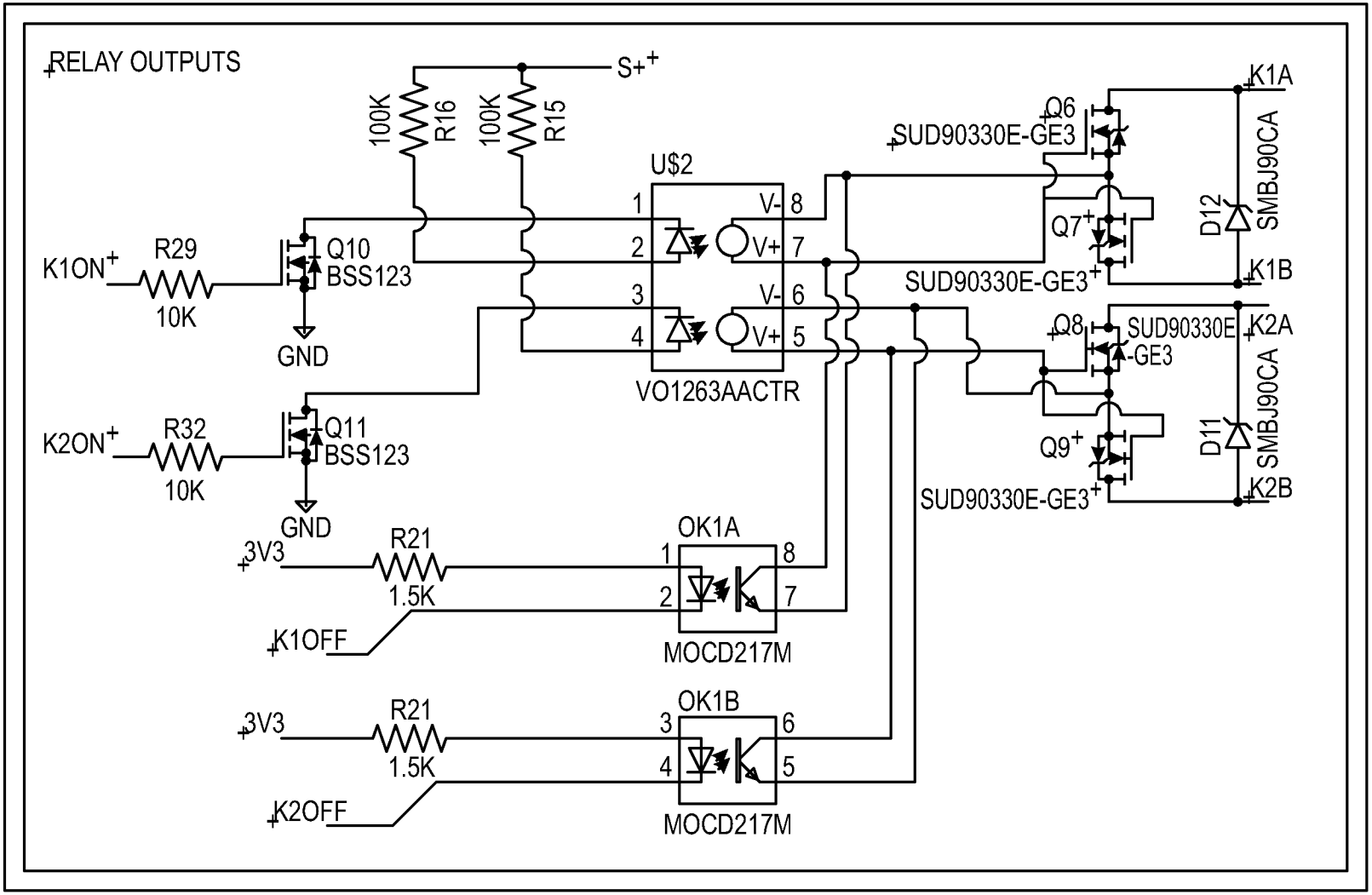
FIG. 9 illustrates the alarm device connection circuit 22 for a solid-state relay alarm module 1.

FIG. 9 illustrates the alarm device connection circuit 22 of a solid-state relay alarm module 1 that may be connected to and control both a normally open and a normally closed a relay-controlled alarm device 222 depending on how the alarm device connection circuit 22 is driven by the processor 20. An isolated FET driver is unique in its lack of turn-off circuitry which would require a high input load to maintain the relay on state. The relay FETs are selected especially for their RDSon, since internally generated heat is the major challenge in the design. Driving a single channel generates a constant current flow through 100K resistor, which is nominally 0.3 mA. The alarm device connection circuit 22 can mimic a normally closed output by turning the relay on normally. If the device is left unpowered however, leakage in the optoisolator will eventually turn off the relay after several seconds. Under normal operation for open contact, the FET driver is stopped and the optoisolator is pulsed by an output of the processor 20 to drain the FET gate voltage and turn off the relay.

SOM—Supervised Output

Figure 10:
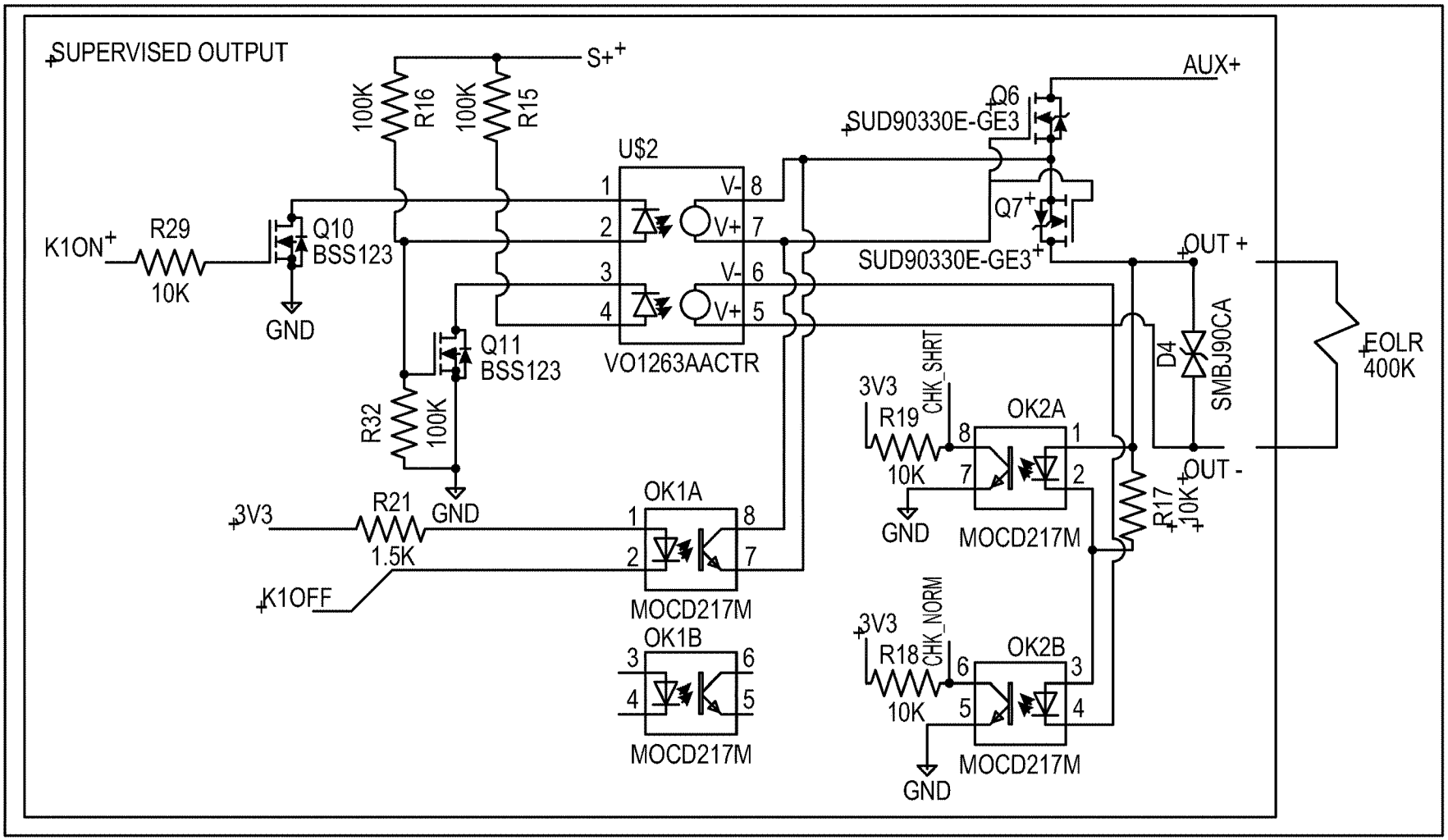
FIG. 10 illustrates the alarm device connection circuit 22 of a supervised output relay alarm module 1.

FIG. 10 illustrates the alarm device connection circuit 22 of a supervised output relay alarm module 1 that may be connected to and control a supervised output alarm device 222 depending on how the alarm device connection circuit 22 is driven by the processor 20. SLC wiring will be supervised when not passed through the alarm module 1 by turning on the secondary FET driver to develop a reverse voltage across the EOLR when wiring is intact and drive an optoisolator, it's possible this design could allow continuous supervision. When short, current will flow through both OK2A photodiodes since the resistance of the diode is much less than 10K when voltage exceeds its Vf. When open, OK2A will be off for both photodiodes. When normal, the 10K resistance will not provide a high enough voltage for the first OK2A to turn on, however current will flow through the second photodiode of OK2A. The main challenge is the maximum current the VO1263AA can deliver, around 10 uA with 10 mA input current is not enough to drive any arbitrary optoisolator especially with dark current issues. Other design options still need to be explored.

SG-RI—Red/Green Remote Indicator

Figure 11:
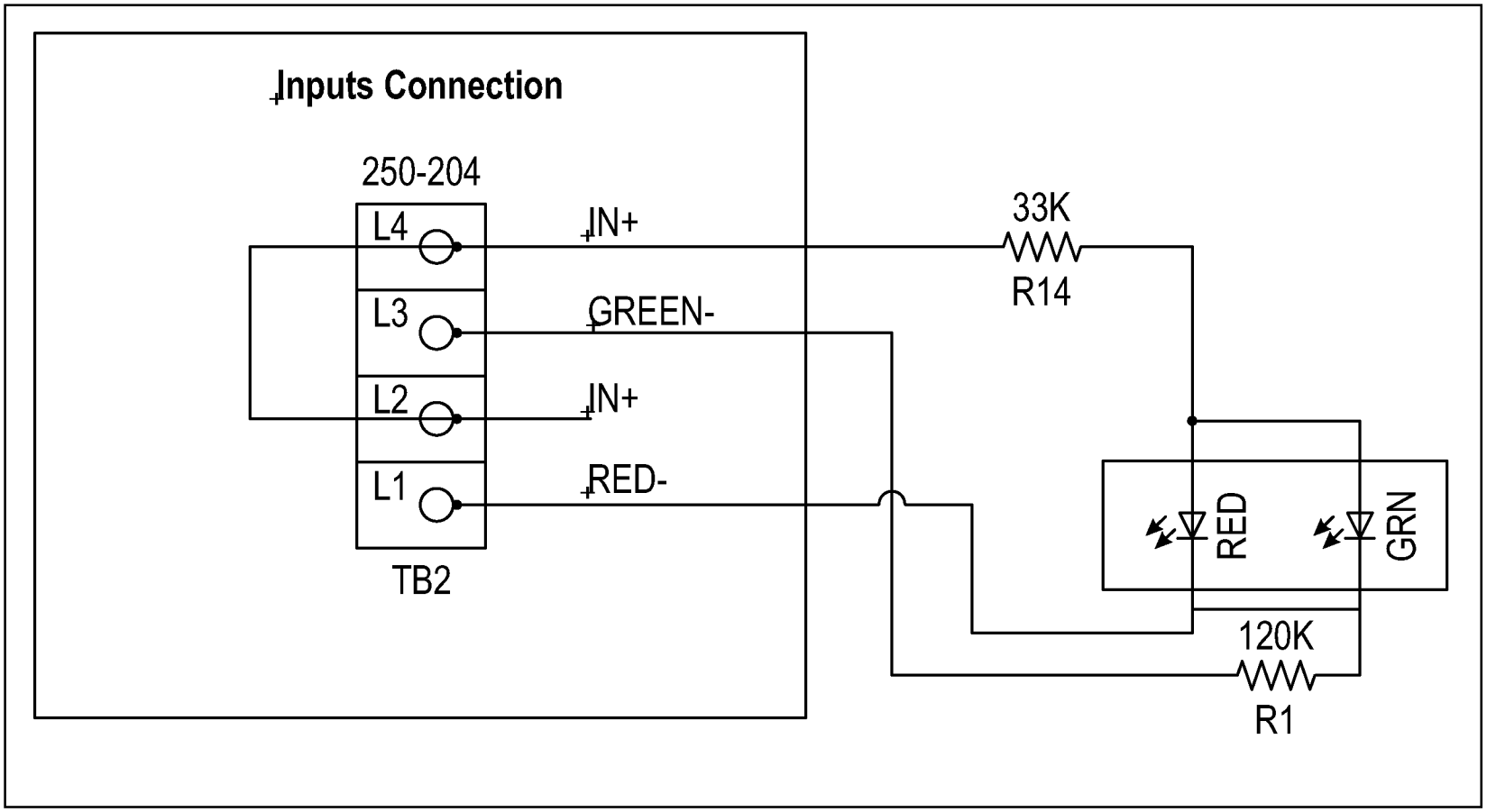
FIG. 11 illustrates the alarm device connection circuit 22 of remote indicator relay alarm module 1.

FIG. 11 illustrates the alarm device connection circuit 22 of remote indicator relay alarm module 1. The remote indicator relay alarm module 1 does not share the communication circuit of the alarm system and has no address. The remote indicator relay alarm module 1 however does include an NFC chip so that it doesn't appear to be a dead device within the NFC system, as well as the other benefits of the NFC technology. The alarm module 1 includes a high-intensity, bicolor red/green LED with high resistance to limit the input current to a low value. Since the intent is to allow driving from the SLC loop or other source, the current draw must be very low to avoid the likelihood of limiting devices due to loop loading. TVS is probably not required given the high impedance. The illustrated alarm device connection circuit 22 allows that red and green may be driven independently, if both are powered, the red will override the green due to its lower voltage which is important for alarm indication.

NFC Controller as Module Wireless Communications Device

Although several wireless communications devices and protocols may be used for the wireless communications device 24, a preferred wireless communications device 24 comprises a Near Field Communications (NFC) controller such as the ST25DV04K for which the alarm module circuit board 25 antenna layout is essentially the same for all varieties of alarm modules 1 with the NFC antenna traced or run at the perimeter of the alarm module circuit board 25 and on both sides to provide the required antenna characteristics and optimize the space used. Alternately, the NFC antenna may be moved to permit alternate NFC IC placements or to accommodate alternately sized and positioned passive and active components of the alternate varieties of alarm device connection circuits 22. An exemplary NFC IC is the ST25DV04K or equivalent which enables use of a common NFC memory map. The 32 bit-length sectors is optimal for Java reading and writing operations.

While the preferred NFC IC provides several inherent capabilities such as unique ID, wireless communication, memory reading and writing, the alarm modules 1 disclosed herein also include additional capabilities such as device addressing, user password protection, related installation information display, software import for automated programming, programming of any configurable items, firmware bootloading. As one option, the alarm module 1 may exploit the NFC unique ID that is created by the wafer fabrication process of the NFC chip to offer a means for tracking alarm module 1 and avoiding counterfeit alarm modules 1.

During standard alarm module 1 service procedures, a wireless configuration device 70, which may be a dedicated configuration device, or a user smart phone, tablet, or laptop equipped with a similar or compatible NFC compliant device, communicates module configuration transmissions 200 to identify, authenticate, and configure the alarm module 1 as disclosed herein. The reader application operated by the user of the wireless configuration device 70 may look for several confirmatory data before authenticating each alarm module 1. The reader application verifies that the NFC chip is of the preferred manufacturer (e.g. by STM, and of the ST25DV family), which is exceedingly difficult for a counterfeiter to mimic. To achieve the addressing function, the NFC tag memory is read from and written to by the reader application on the wireless configuration device 70. Because the memory is part of the NFC tag, the wireless configuration device 70 will read or write it without alarm system power to the alarm module 1, and without risk to the main processor 20. This NFC tag memory location is read from by the alarm module 1 processor 20 via I2C interface on startup or reset and read and write functions are protectable by a password at the tag command level. The user password may be a setting to the tag memory similar to the address. The user password may be of length to match the alarm system control panel 3 options.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A signaling line current (SLC) alarm module for connection between an alarm device and a signaling line, comprising:

a Near Field Communications (NFC) controller configured to communicate alarm module configuration transmissions and write an alarm module address received during alarm module configuration transmissions;

at least one configurable alarm device connection circuit selected from an SLC powered contact monitor input configurable for CLASS A or CLASS B operation, an SLC powered zone monitor input configurable for CLASS A or CLASS B operation, a configurable SLC powered relay output, an SLC powered configurable supervised output, and an SLC powered configurable short circuit isolator, the alarm device connection circuit selected configurable based on received alarm module configuration transmissions; and a processor coupled to the wireless communications device, the alarm device connection circuit, the processor configured to write the alarm module address after the NFC controller, execute at least one software process capable to configure the configurable alarm device connection circuit based on the alarm module configuration transmissions and to communicate over the signaling line using the alarm module address;

wherein the alarm module is addressable by a fire alarm control panel with the alarm module address, the wireless communications device is wirelessly connectable to a wireless configuration device positioned only within the immediate proximity of the alarm module, and the alarm module is configurable based on an alarm device connectable at the alarm device connection circuit, the alarm device selected from a CLASS A contact monitor, a CLASS B contact monitor, a CLASS A SLC powdered zone monitor, a CLASS B SLC powered zone monitor, a SLC powered relay, a supervised output, and a short circuit isolator, and the module configuration transmissions receivable from the wireless configuration device.

2. The alarm module in claim 1, wherein the type of configurable alarm device connection circuit selected is communicable to the wireless configuration device from the alarm module.

3. The alarm module in claim 1, wherein the immediate proximity of the alarm module comprises within about 3 feet of the alarm module.

4. The alarm module in claim 1, wherein the module configuration transmissions are readable by the wireless configuration device from an NFC tag functionally associated to the NFC controller.

5. The alarm module in claim 1, wherein the at least one software process to configure the alarm module based on the module configuration transmissions includes authenticating the NFC controller.

6. The alarm module in claim 1, further comprising a module housing sized and dimensioned for receipt into a single gang box.

7. The alarm module in claim 6, wherein the module housing further comprises at least one housing mounting flange wherein the housing mounting flange is sized and dimensioned for alignment with mounting apertures on the single gang box.

8. The alarm module in claim 6, wherein the module housing further comprises a module housing front and a module housing rear.

9. The alarm module in claim 8, wherein the module housing front includes an alarm module visual indicator LED.

10. The alarm module in claim 8 wherein the wireless receiver, alarm sensor, and processor are positioned on an alarm module circuit board within and between the module housing front and module housing rear.

11. A method of facilitating configuration of an alarm module for a Signaling Line Circuit (SLC) based fire alarm system including a Fire Alarm Control Panel (FACP), comprising:

communicating module configuration transmissions between a Near Field Communications (NFC) controller within the alarm module and a wireless configuration device positioned proximate thereto, the alarm module also comprising a processor, an alarm device connection circuit, and the wireless configuration device configured to communicate with the NFC controller;

receiving an alarm module address to the NFC controller from the wireless configuration device;

the processor, writing the alarm module address to a memory; and displaying at least one alarm module configuration option obtained as a result of the module configuration transmissions on a visual display of the wireless configuration device;

configuring an alarm device connection circuit selected from an SLC powered contact monitor input configurable for CLASS A or CLASS B operation, an SLC powered zone monitor input configurable for CLASS A or CLASS B operation, a configurable SLC powered relay output, an SLC powered configurable supervised output, and an SLC powered configurable short circuit isolator, the configuring based on received alarm module configuration transmissions;

connecting an alarm device to the alarm device connection circuit, the alarm device selected from a CLASS A contact monitor, a CLASS B contact monitor, a CLASS A SLC powered zone monitor, a CLASS B SLC powered zone monitor, a SLC powered relay, supervised output, and a short circuit isolator, and the FACP, addressing the alarm module on the SLC using the alarm module address.

12. The method of facilitating configuration in claim 11, further comprising identifying a variety of alarm modules on the wireless configuration device based the module configuration transmissions.

13. The method of facilitating configuration in claim 11, further comprising displaying options for and enabling programming of the alarm module address for identification of the alarm module by the FACP.

14. The method of facilitating configuration in claim 11, further comprising displaying on the wireless configuration device instructions for positioning the wireless configuration device within the immediate proximity of the alarm module.

15. The method in claim 11, further comprising displaying options for configuring the alarm module for an alarm device selected from a relay monitoring input, a current source monitoring input, a contact monitor input, and an SLC powered zone monitor.

16. The method in claim 11, further comprising displaying options for configuring the alarm module for operation as an alarm module selected from an SLC powered contact monitor input configurable for CLASS A or CLASS B operation, and an SLC powered zone monitor input configurable for CLASS A or CLASS B operation, a configurable SLC powered relay output, an SLC powered configurable supervised output, and an SLC powered configurable short circuit isolator based on module configuration transmissions.

17. The method in claim 11, further comprising identifying the functional capabilities and configurable options of the alarm module by writing a unique code to the alarm module and making that unique code available to a reader application on the wireless configuration device.

18. A method of configuring an alarm module for a Signaling Line Circuit (SLC) including a Fire Alarm Control Panel (FACP), comprising:

wirelessly, writing an alarm module address for use by the FACP on the SLC and reading the capabilities and configuration options of the alarm module by a wireless configuration device positioned proximate to the alarm module, the alarm module comprising an NFC controller, a processor, and an alarm device connection circuit selected from an SLC powered contact monitor input configurable for CLASS A or CLASS B operation, an SLC powered zone monitor input configurable for CLASS A or CLASS B operation, a configurable SLC powered relay output, an SLC powered configurable supervised output, and an SLC powered configurable short circuit isolator, the wireless configuration device configured to communicate with the NFC controller;

displaying at least one configuration option for the alarm device connection circuit obtained as a result of reading the reading the capabilities and configuration options of the alarm module; and wirelessly, writing a configuration option to the alarm module from the wireless configuration device positioned proximate to the alarm module;

modifying the function of the alarm module as a result of the writing; and the FACP, communicating with an alarm device connected to the alarm device connection circuit via the alarm module and using the alarm module address, the alarm device selected from a CLASS A contact monitor, a CLASS B contact monitor, a CLASS A SLC powered zone monitor, a CLASS B SLC powered zone monitor, a SLC powered relay, a supervised output, and a short circuit isolator.

* * * * *